US008104758B2

(12) United States Patent
Tanaka et al.

(10) Patent No.: US 8,104,758 B2
(45) Date of Patent: Jan. 31, 2012

(54) SHEET FINISHER AND IMAGE FORMING SYSTEM PROVIDED THEREWITH

(75) Inventors: Yu Tanaka, Yokohama (JP); Hiroyuki Wakabayashi, Hachioji (JP); Masaaki Uchiyama, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 146 days.

(21) Appl. No.: 12/717,393

(22) Filed: Mar. 4, 2010

(65) Prior Publication Data

US 2010/0225042 A1 Sep. 9, 2010

(30) Foreign Application Priority Data

Mar. 9, 2009 (JP) ..... 2009-054829

(51) Int. Cl.
*B65H 37/04* (2006.01)

(52) U.S. Cl. ..... 270/58.11; 270/58.12; 270/58.16; 270/58.08

(58) Field of Classification Search ..... 270/58.08, 270/58.11, 58.12, 58.14, 58.16, 58.18
See application file for complete search history.

(56) References Cited

U.S. PATENT DOCUMENTS 5,112,034 A * 5/1992 Uto et al. ..... 270/58.12
5,765,824 A * 6/1998 Kawano et al. ..... 270/58.11
6,315,288 B1 * 11/2001 Sugishima et al. ..... 271/303
6,332,606 B1 * 12/2001 Seki ..... 270/59
7,192,020 B2 * 3/2007 Hayashi et al. ..... 270/58.11
7,354,034 B2 * 4/2008 Nakamura et al. ..... 270/58.1
7,354,036 B2 * 4/2008 Hayashi et al. ..... 270/58.12
7,510,178 B2 * 3/2009 Miyazaki et al. ..... 270/58.1
7,543,806 B2 * 6/2009 Nakamura et al. ..... 270/58.11
7,780,159 B2 * 8/2010 Nishimura et al. ..... 270/58.11
7,874,551 B2 * 1/2011 Iguchi ..... 270/58.11
7,900,905 B2 * 3/2011 Kiriyama ..... 270/58.1

FOREIGN PATENT DOCUMENTS

JP 11-157741 A 6/1999

* cited by examiner

*Primary Examiner* — Patrick Mackey
(74) *Attorney, Agent, or Firm* — Holtz, Holtz, Goodman & Chick, PC

(57) ABSTRACT

A sheet finisher includes: a stacking section having a stacking surface arranged to be tilted, and a stopper located below the stacking surface; a sheet finishing section which post-processes for a sheet bundle that hits the stopper and is stacked on the stacking section; a conveying section which sends two sheets to the stacking section under the condition that the two sheets are shifted each other in a conveyance direction and are superimposed; an input section in which sheet type information is inputted; and a controller which adjusts a shift amount between the two sheets so that the sheet on a lower side precedes toward the stopper by a prescribed amount, when a conveyance condition of the conveyance section is changed based on the inputted sheet type information inputted, and the two sheets are conveyed to the stacking section with the two sheets superimposed.

28 Claims, 9 Drawing Sheets

SHEET FINISHER AND IMAGE FORMING SYSTEM PROVIDED THEREWITH

This application is based on Japanese Patent Application No. 2009-054829 filed on Mar. 9, 2009, which is incorporated hereinto by reference.

BACKGROUND OF THE INVENTION

The present invention relates to a sheet finisher that conducts post-processing for a sheet and to an image forming system equipped with the sheet finisher.

In the past, there has been known an image forming system wherein various types of sheet finishers having functions respectively for punching processing, stapling processing, folding processing and book-binding processing for the sheet subjected to image forming can be mounted on a copying apparatus or a printing apparatus representing an image forming apparatus.

In the image forming system of this kind, there is known a technology to convey two superimposed sheets, for doing post-processing efficiently on sheets which have undergone high speed copying.

Unexamined Japanese Patent Application Publication No. H11-157741 discloses a technology to superimpose two sheets by two branched channels and by stoppers located at downstream sides of the branched channels wherein a sheet positioned to be on the upper side on the stacking section is shifted in a way to precede in the conveyance direction so that sheets are aligned correctly where superimposed sheets are stored temporarily.

The stacking section is arranged to be tilted, and when the superimposed sheets have left the conveyance roller, they are returned along the stacking section in the direction opposite to the conveyance direction by their empty weight and a returning member, to hit the lower stopper to be aligned. However, if the lower sheet is ahead in the conveyance direction, an action of the returning member for the sheet on the upper side does not have an influence on the sheet in the lower side, thus, the sheet in the lower side is stored in the stacking section while keeping the state that the sheet in the lower side is shifted.

To solve this point, in the technology disclosed in Unexamined Japanese Patent Application Publication No. H11-157741, the sheet on the upper side is shifted forcibly so that it may precede in the conveyance direction, and shifting of the sheet is conducted by changing a diameter of a conveyance roller of each branched path, or by changing a speed of rotation of the conveyance roller, or by arranging stoppers at different distances on branched paths, to solve the aforesaid point.

An image forming apparatus has been made to be highly efficient in terms of speeding up of processing speed and of diversification of sheets to be used, and for this trend, a sheet finisher is also demanded to be highly efficient. Under this situation, it has become impossible to obtain sufficient performances, even when the technology in Unexamined Japanese Patent Application Publication No. H11-157741 is used as it is.

Namely, in the technology in Unexamined Japanese Patent Application Publication No. H11-157741, two sheets are shifted by an equal amount of shifting, but an amount of actual shifting varies depending on a type of the sheet, and in a remarkable occasion, a sheet to precede does not precede, and an occasion where adjustment in the stacking section is impossible has come to an actual existence.

In this case, the diversification of sheets means that a range of thickness of sheets that can be used is enlarged and the number of types of sheets that can be used is increased. Further, let it be assumed that the sheet type is a generic name for a sheet thickness (a basis weight, i.e. $g/m^2$) and sheet kinds (coated sheet, color sheet, quality sheet and normal sheet).

For example, in the case of sheets wherein friction force between sheets is large as in normal sheet and sheets wherein friction force is small as in coated sheet, there is dispersion in a shift amount.

Further, if a shift amount is established to be appropriate for a thick sheet, thin sheets slip between them, and a shift amount is varied. On the contrary, when a shift amount is established to be appropriate for a thin sheet, pressing force becomes to be high and a shift amount is reduced.

Dispersion of these amounts of shifting is not large in the case of a low speed copying machine, which has not been a problematic level. However, they are becoming a problem as speeding up and diversification of sheets are carried forward as stated above.

SUMMARY OF THE INVENTION

Aspects of the invention are as follows.

One aspect is a sheet finisher that is characterized to have a stacking section having a stacking surface arranged to be tilted, and a stopper positioned to be below the stacking section, a sheet finishing section that conducts post-processing for a sheet bundle that hits the aforesaid stopper and is stacked on the aforesaid stacking section, a conveying section that sends two sheets to the stacking section under the condition wherein the two sheets are shifted in the conveyance direction and are superimposed, an input section in which sheet type information for a sheet is inputted and a controller that adjusts a shift amount of a sheet so that the sheet on the lower side may precede toward the stopper side by a prescribed amount, in the case of changing the conveyance condition of the aforesaid conveyance section based on the sheet type information inputted by the input section, and in the case of delivering two sheets to the stacking section under the state where the two sheets are superimposed.

Another aspect is a sheet finisher that has a stacking section provided with a stacking surface arranged to be tilted and with a stopper located below the aforesaid stacking surface, a sheet finishing section that conducts post-processing on the sheet stacked on the stacking section and a conveying section that has a pair of conveyance rollers, then, supplies two superimposed sheets to the paired conveyance rollers, and supplies the sheets to the stacking section by shifting the sheets depending on a difference between line speeds of respective rollers of the paired conveyance rollers, and delivers sheets by shifting them so that the sheet on the lower side may precede toward the stopper side, when delivering two sheets to the stacking section under the state where the two sheets are superimposed, and aligns the sheets by causing an end portion of the sheet to hit the stopper, wherein there are provided an input section into which sheet type information for a sheet is inputted, and a controller that changes conveyance condition of the paired conveyance rollers in accordance with the sheet type information inputted by the input section, and regulates a shift amount for the sheet so that the sheet on the lower side may precede toward the stopper side by a prescribed amount.

Still another aspect is a sheet finisher that has a stacking section provided with a stacking surface arranged to be tilted and with a stopper located below the aforesaid stacking surface, a sheet finishing section that conducts post-processing on the sheet stacked on the stacking section and a conveying section that has two sets of conveyance paths which join after being branched, and supplies sheets to the stacking section by superimposing two sheets by delivering a single sheet into each of the conveyance paths, and by shifting sheets depending on a difference between line speeds of respective conveyance rollers arranged respectively in the conveyance paths, and delivers the sheet on the lower side by shifting so that the sheet on the lower side may precede toward the stopper side and aligns the sheet on the lower side by causing an end portion of the sheet to hit the stopper, when delivering the sheet under the condition where the two sheets are superimposed on the aforesaid stacking section, wherein there are provided an input section into which sheet type information for a sheet is inputted, and a controller that changes conveyance condition of the conveyance rollers in accordance with the sheet type information inputted by the input section, and regulates a shift amount for the sheet so that the sheet on the lower side may precede toward the stopper side by a prescribed amount.

Further, another aspect is a sheet finisher that has a stacking section provided with a stacking surface arranged to be tilted and with a stopper located below the aforesaid stacking surface, a sheet finishing section that conducts post-processing on the sheet stacked on the stacking section and a conveying section that delivers two sheets to the stacking section under the condition where the two sheets are shifted each other in the conveyance direction, and delivers the sheet on the lower side by shifting so that the sheet on the lower side may precede toward the stopper side and aligns the sheet on the lower side by causing an end portion of the sheet to hit the stopper, when delivering the sheet to the stacking section under the condition where the two sheets are superimposed, wherein there are provided an input section into which a shift amount for the sheets is inputted, and a controller that changes a conveyance condition of the conveying section in accordance with the shift amount inputted into the input section, and regulates a shift amount for the sheets so that the sheet on the lower side on the stacking side may precede toward the stopper side by a prescribed amount.

DETAILED DESCRIPTION OF THE PREFERRED EMBODIMENT

Figure 1:
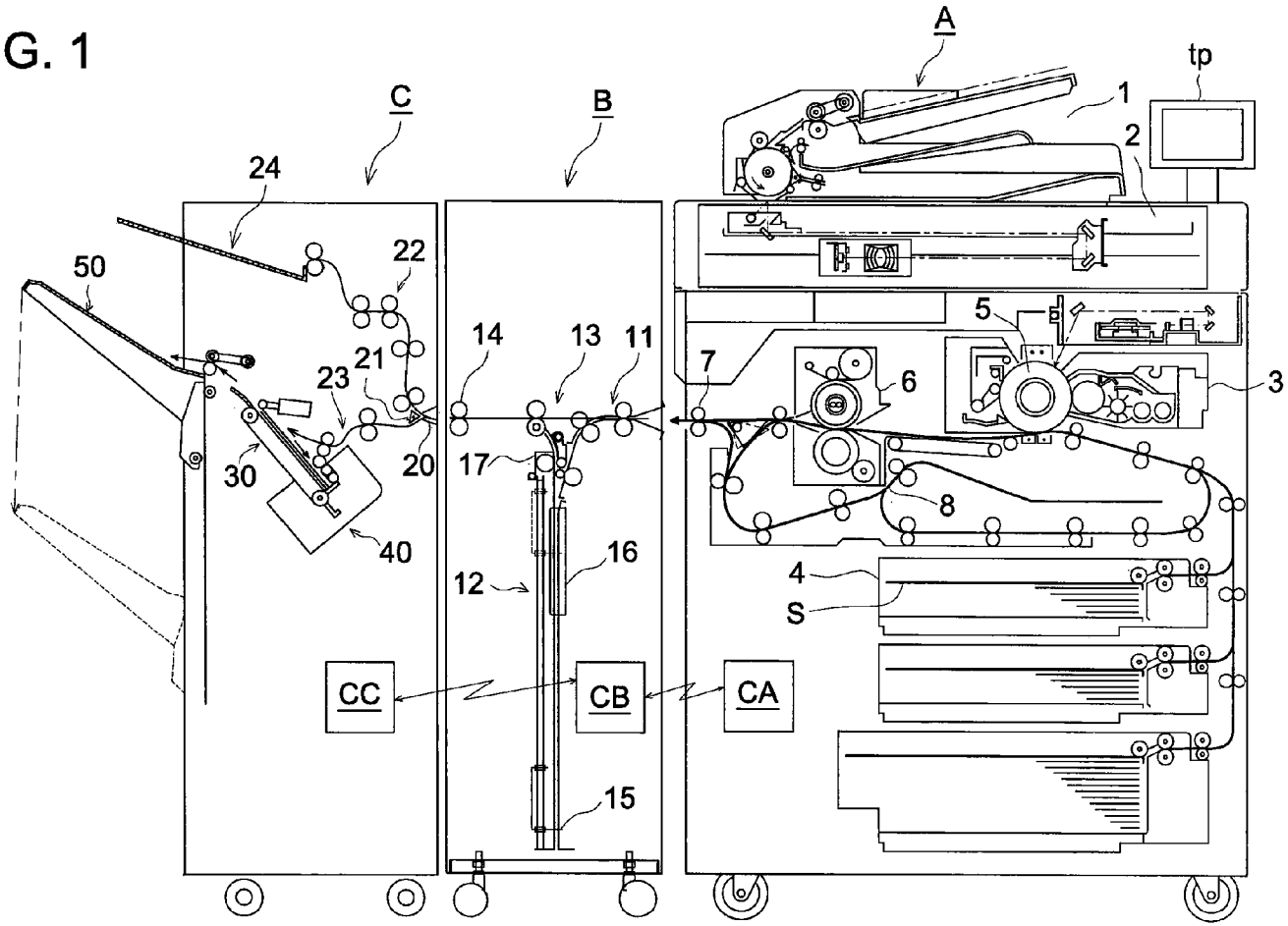
FIG. 1 is a general structural view of an image forming system on which the invention is applied.

An image forming system on which the invention is applied will be explained as follows, referring to the drawings.

FIG. 1 is a general structural view of an image forming system having image forming apparatus A, first sheet finisher B and second sheet finisher C. The first sheet finisher B is connected to the middle between the image forming apparatus A and the second sheet finisher C. Further, the image forming apparatus A, the first sheet finisher B and the second sheet finisher C have respectively controllers CA, CB and CC, and each controller controls each sheet finisher by communicating with other controllers.

[Image Forming Apparatus A]

Image forming apparatus A has, on its upper portion, automatic document feeder 1 and image reading section 2, and has, on its lower portion, printer section 3.

In the printer section 3, the numeral 4 represents a sheet storing section that stores sheet S. A toner image formed on photoconductor 5 through an electrophotographic process is transferred onto sheet S that is fed from the sheet storing section 4, and an image thus transferred is fixed by fixing device 6. The sheet S that has undergone the fixing process is ejected by sheet ejection roller 7 from an sheet-ejection outlet.

In the case of two-sided copying, a sheet is conveyed downward at this side of the sheet ejection roller 7, to be returned again to the transfer position through two-sided conveyance path 8, and an image is formed on the reverse side of the sheet.

The symbol tp represents an operation display section that is equipped with a touch panel wherein touch screens are arranged to be superimposed on a display section that is composed of liquid crystal panels. It is possible to practice, from the operation display section tp, various kinds of inputs of numerical values and mode setting as well as setting of output modes which employ sheet finisher B and sheet finisher C. Pieces of information of numerical values and modes thus established are sent to respective controllers, to become parameters for the control.

Sheet S ejected from the image forming apparatus A is conveyed to the second sheet finisher C through the first sheet finisher B.

[First Sheet Finisher B]

First sheet finisher B is provided for the purpose of improving productivity in the second sheet finisher C for the image forming system composed of image forming apparatus A and the second sheet finisher C, and it can also be called an intermediate conveyance device because it is provided between the both items. Incidentally, printing operations can also be practiced even by the construction of only the image forming apparatus A and the second sheet finisher C excluding the first sheet finisher B.

The first sheet finisher B is one wherein sheets conveyed from the image forming apparatus A are superimposed to be two-ply sheets in sheet superimposing section 12, and the two sheets are conveyed to succeeding second sheet finisher C as a set of two superimposed sheets. Owing to the sheet conveyance in the form of the superimposed two-ply sheets as in the foregoing, an interval for sheets to be conveyed to the second sheet finisher C is broadened, which makes it possible to secure sheet finishing time in the second sheet finisher C.

The first sheet finisher B is composed of sheet carry-in section 11, sheet superimposing section 12, bypass conveyance section 13, and of sheet carry-out section 14. In the sheet superimposing section 12, there are arranged lower end stopper 15, width aligning member 16 and upper end stopper 17.

When superimposing two sheets, first sheet S coming from the image forming apparatus A is stored first in sheet superimposing section 12 having two guide plates. In this case, the lower end stopper 15 is located at the position corresponding to the sheet size to hold the lower end of the sheet S. Then, when the second sheet S comes, the lower end stopper 15 goes up slightly so that the first sheet and the second sheet may not collide each other. When the second sheet enters the sheet superimposing section 12, the lower end stopper 15 goes down again so that the two sheets may be stacked to be superimposed.

Next, the lower end stopper 15 goes up under the condition where the upper end stopper 17 enters the conveyance path as illustrated, to practice aligning in the conveyance direction by causing a leading edge of the sheet to hit the upper end stopper 17. Then, the width aligning members 16 arranged on both ends in the sheet width direction in the sheet superimposing section 12, tap two sheets lightly to align them, simultaneously with or after the foregoing.

When aligning in the conveyance direction and aligning in the width direction come to an end, the upper end stopper 17 recedes, and two sheets are pushed up in the state to be superimposed, by the lower end stopper 15 to be sent to the second sheet finisher C from the sheet carry-out section 14. After the two superimposed sheets S have left the sheet superimposing section 12, the third sheet S enters the sheet superimposing section 12, and the same processing is carried out afterwards.

When there is no superimposing processing, a sheet carried in from the sheet carry-in section 11 is sent to the second sheet finisher C from the sheet carry-out section 14 through bypass conveyance section 13.

[Second Sheet Finisher C]

In the schematic explanation of the second sheet finisher C that is given by using FIG. 1, sheet S that is incoming from the first sheet finisher B is received at introduction port 20, and is guided by conveyance path switching member 21 to the first conveyance path 22 or to the second conveyance path 23.

Sheet S guided to the first conveyance path 22 is ejected out to fixed sheet ejection section 24 without being subjected to post-processing. On the other hand, sheet S guided to the second conveyance path 23 undergoes edge-stapling processing practiced by stapler section 40 after plural sheets composing one print set are stacked on stacking section 30, and then, one print set of sheets is ejected to going up and down sheet ejection section 50. The going up and down sheet ejection section 50 descends each time sheets are ejected, thus, a large number of sheets can be stacked.

Figure 2:
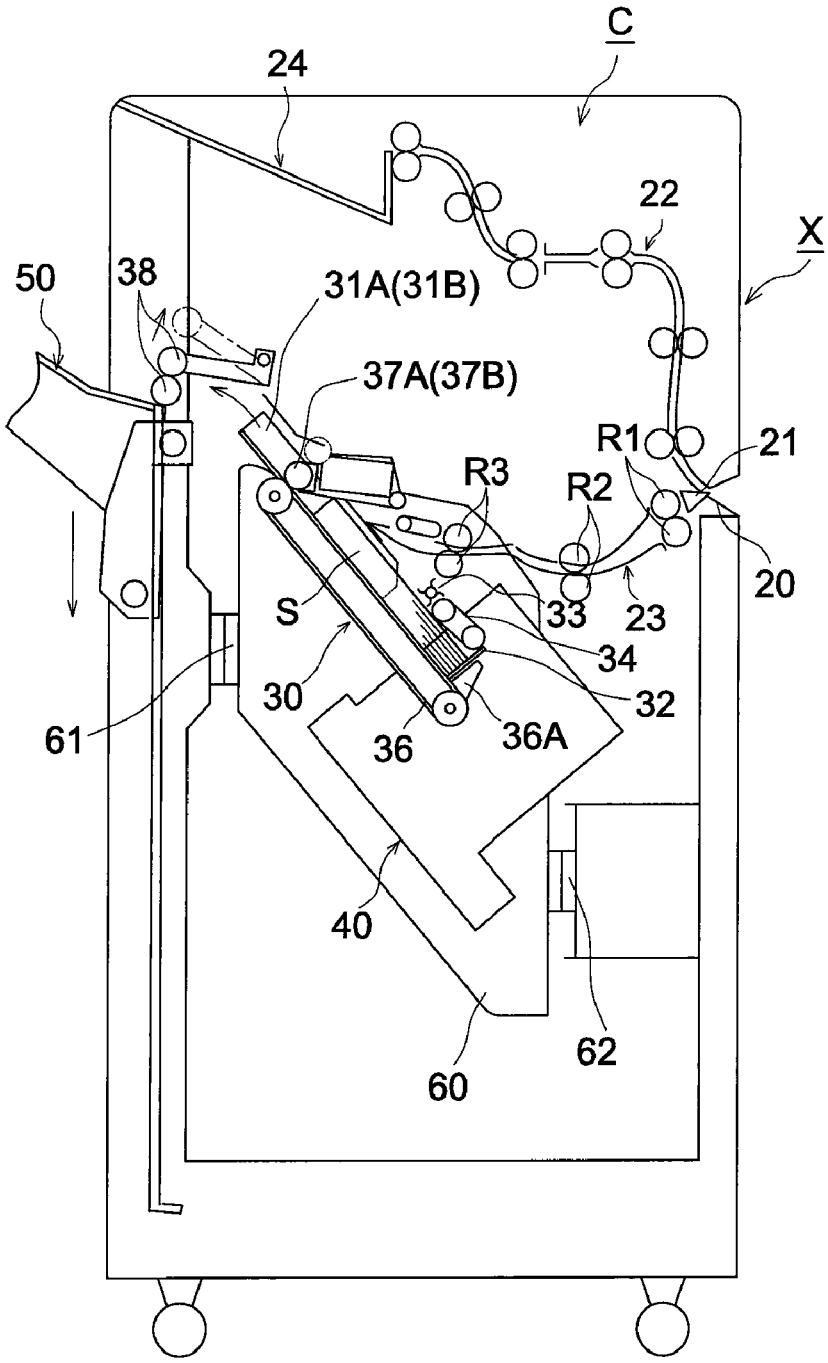
FIG. 2 is a sectional view of a sheet finisher to which Example 1 of the invention is applied.
Figure 3:
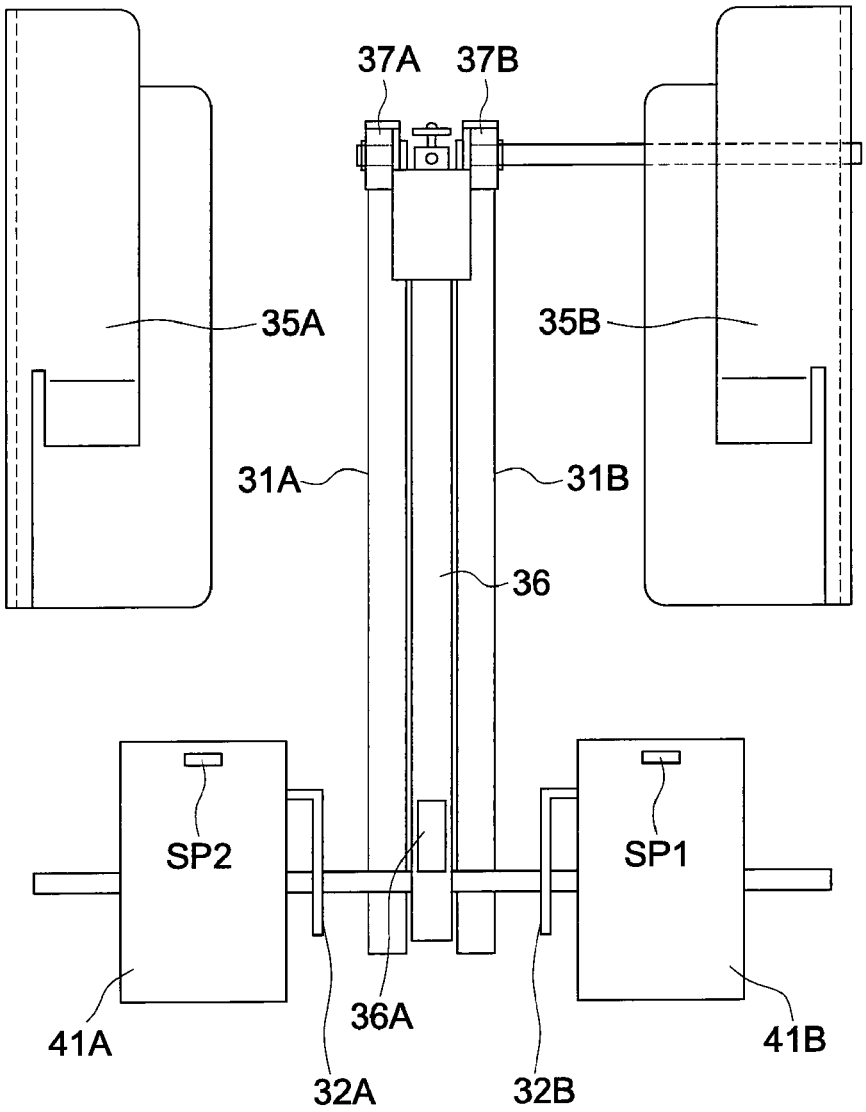
FIG. 3 is a top view for a stacking section and a stapler section in FIG. 2.

FIG. 2 is a sectional view for explaining the second sheet finisher C in a more detailed manner, while, FIG. 3 is a top view wherein stacking section 30 and stapler section 40 are viewed in the direction of arrow X in FIG. 2, and an explanation will be given as follows, referring to the both drawings.

On the second conveyance path 23, there are arranged conveyance rollers R1, R2 and R3, and these conveyance rollers send two sheets S superimposed in the first sheet finisher B to stacking section 30 arranged to be tilted.

The stacking section 30 is arranged to be tilted, and has therein guide plates 31A and 31B extending in the conveyance direction, a paddle roller (also referred to as an urging member) 33 which guide carried-in sheets S toward a stopper, guide belt 34, stopper 32 that catches and stops carried-in sheet S at its lower portion and aligning regulating members 35A and 35B respectively on the right and left.

Guide plates 31A and 31B are two plate-like members divided in the direction perpendicular to the sheet conveyance direction, and belt member 36 is arranged between the aforesaid two plate-like members to be in parallel with the guide plates 31A and 31B. On the belt member 36, there is provided push-up member 36A that is positioned, in the case of storing sheets, on the same line as in stopper 32 to catch and stop an end surface of the sheet, and it holds the end surface of the sheet to push it up with rotation of the belt member 36 when post-processing is terminated.

At positions of tips of the guide plates 31A and 31B, there are arranged send-out rollers 37A and 37B each being held on the guide plate to be capable of touching and leaving the guide plate, and further, the second send-out rollers 38 are arranged on the downstream side in the conveyance direction. The second send-out rollers 38 are constructed to be capable of being displaced from the paired rollers, and when receiving one print set of sheet bundle, the paired rollers separate from each other to receive the sheet bundle, and then, the sheet bundle is pinched to be ejected to going up and down sheet ejection section 50.

Each of the aligning regulating members 35A and 35B is formed in a U-shape, and its bottom surface forms a stacking surface for sheets together with guide plates 31A and 31B and with belt member 36, to store sheets S. The aligning regulating members 35A and 359 are provided to be movable from side to side with an unillustrated drive mechanism, thus, the sheet S is tapped lightly from both sides in the width direction of sheet S for aligning in the width direction.

When all sheets constituting one print set are stacked on stacking section 30, stapler section 40 carries out stapling processing for the end surface at the stopper side of the sheets. The stapler section 40 has two stapler mechanisms 41A and 41B, and these stapler mechanisms 41A and 41B are held to be capable of moving from side to side in FIG. 3, thus, each of the stapler mechanisms 41A and 419 moves to the stapling position depending on the sheet size to carry out stapling processing on each of two locations SP1 and SP2 on the end surface of the sheets.

Conveyance roller R3, stacking section 30, stapler section 40 and members constituting the aforesaid items are held on supporting plate 60 on front and rear in the direction perpendicular to the page surface in FIG. 2, and the supporting plate 60 is constructed to be capable of being drawn out toward this side of the apparatus by slide rails 61 and 62, which makes it possible to replenish staples and to clear jamming.

In the explanation of operations of respective sections in the case of performing post-processing in the second sheet finisher C having the aforesaid construction, sheet S on which an image is formed by image forming apparatus A is superimposed to be of two-ply by the first sheet finisher B, and it is sent to the second sheet finisher C. In this case, leading edges of the two-ply sheets S are in the state of alignment.

The two-ply sheets S enter conveyance path 23 of the second sheet finisher C, and are fed in stacking section 30 by conveyance rollers R1, R2 and R3. In this case, a sheet of the two-ply sheets S that is on the upper side on the stacking section 30 is shifted from a sheet of the two-ply sheets S that is on the lower side on the stacking section 30 so that the sheet on the lower side may hit stopper 32 first, and conditions for shifting are changed depending on a type of the sheet, which represents a characteristic of the invention, and details of the characteristic will be described later.

Shifting for the sheets so that the sheet on the lower side may hit stopper 32 first implies that the sheet on the upper side precedes in the conveyance direction (the direction from the send-out rollers 37 to the second send-out rollers 38) in the example shown in FIG. 2.

As stated above, sheets S with a sheet on the upper side preceding in the conveyance direction is fed in stacking section 30 advance along the stacking surface of the stacking section 30, and when trailing edges of the sheets have left the conveyance roller R3, the sheets S slide down in the direction opposite to the conveyance direction to hit the stopper 32 to be stopped. In this case, the sheet S on the lower side hits the stopper 32 first, and the sheet S on the upper side is urged by paddle roller 33 and guide belt 34 in the direction toward the stopper, thus, the trailing edge of the sheet S on the upper side and that of the sheet S on the lower side hit the stopper 32 together, and the sheets are aligned for certain.

After this, sheets S in a unit of two sheets are stored in the stacking section 30 in the same manner, and when storage of all sheets S constituting one print set is terminated, aligning regulating members 35A and 35B carry out aligning in the width direction for sheet bundles, and stapler section 40 operates to staple an end portion of the sheet bundle.

Then, a rear end of the sheet bundle which has undergone staple processing is pushed up by push-up member 36A of belt member 36. In this case, the send-out rollers 37 are apart from a guide plate, and the second send-out rollers 38 are in the state of open between the rollers in the same manner. Then, when the leading edge of the sheet bundle enters a space between the send-out rollers 37 and the second send-out rollers 38, the send-out rollers 37 and the second send-out rollers 38 descend to send out the sheet bundle to going up and down sheet ejection section 50.

The image forming system composed of the image forming apparatus A, the sheet finisher B and the sheet finisher C explained above is an example of systems to which the invention can be applied, and examples of the invention applied to the present image forming system will be explained as follows.

EXAMPLE 1-1

The invention is one wherein, when the superimposed two-ply sheets S are fed in the stacking section 30, the sheet S on the upper side is shifted from the sheet S on the lower side by a prescribed amount of shifting, and a shift amount is controlled to be changeable so that a trailing edge of the sheet S on the lower side may hit the stopper 32 first surely (so that the sheet S on the upper side may precede in the conveyance direction). In the aforesaid image forming system, two sheets are superimposed in a way that leading edges of the two sheets are aligned, and they are sent to the second sheet finisher C.

Therefore, in Example 1-1, there is provided a mechanism to shift two sheets forcibly, and a line speed of the roller on the upper side and that of the roller on the lower side are changed depending on sheet types, for stabilizing a shift amount for sheets.

Figure 4:
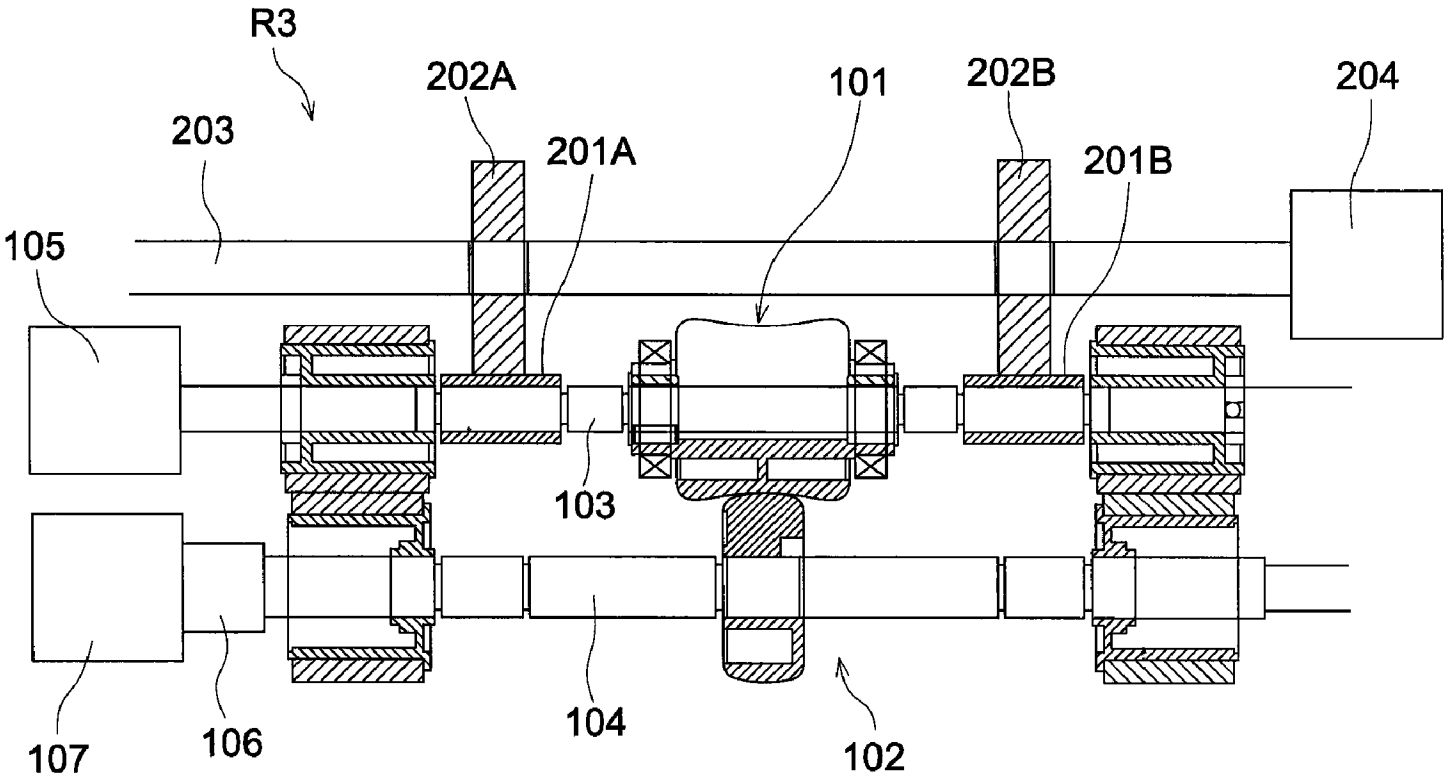
FIG. 4 is a partial sectional view showing the construction of conveyance roller R3 in FIG. 2.

FIG. 4 is a diagram showing the structure of the conveyance roller R3 in each of FIG. 1 and FIG. 2. The conveyance roller R3 is composed of a pair of upper roller 101 and lower roller 102, and each of the upper roller 101 and the lower roller 102 is one wherein three-way split roller bodies are arranged on shaft 103 and shaft 104, and an upper portion of the central roller body has thereon a hollow and a lower portion is barrel-shaped, whereby, a corrugation roller that makes a sheet to be wavy for stable conveyance is structured. In the central roller body, each of upper and lower portions is made of POM (polyacetal resin), and in each of roller bodies on the right and left is covered by EDPM (ethylene propylene rubber) on a supporter made of POM.

Upper drive mechanism 105 is connected to shaft 103 of upper roller 101, and lower drive mechanism 107 is connected to shaft 104 of lower roller 102 through torque limiter 106, so that both of them can be driven independently.

In the invention, a speed of the upper roller 101 is made to be changeable, and two sheets are shifted based on a difference of line speeds between rollers, because of shifting the superimposed two-ply sheets forcibly, the upper drive mechanism 105 is composed of a motor that is changeable in terms of speed. On the other hand, when the number of sheets for one print set is an odd number, there is sometimes an occasion where only one sheet is conveyed, torque limiter 106 is provided in the lower drive mechanism 107, and lower roller 102 follows the speed of upper roller 101 to rotate when a single sheet is conveyed.

Figure 5A:
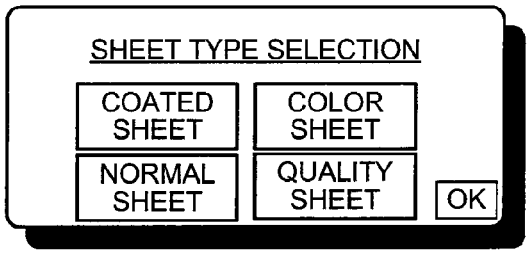
FIG. 5A and FIG. 5B show respectively a sheet selecting screen and a control flow chart in Example 1-1 of the invention.
Figure 5B:
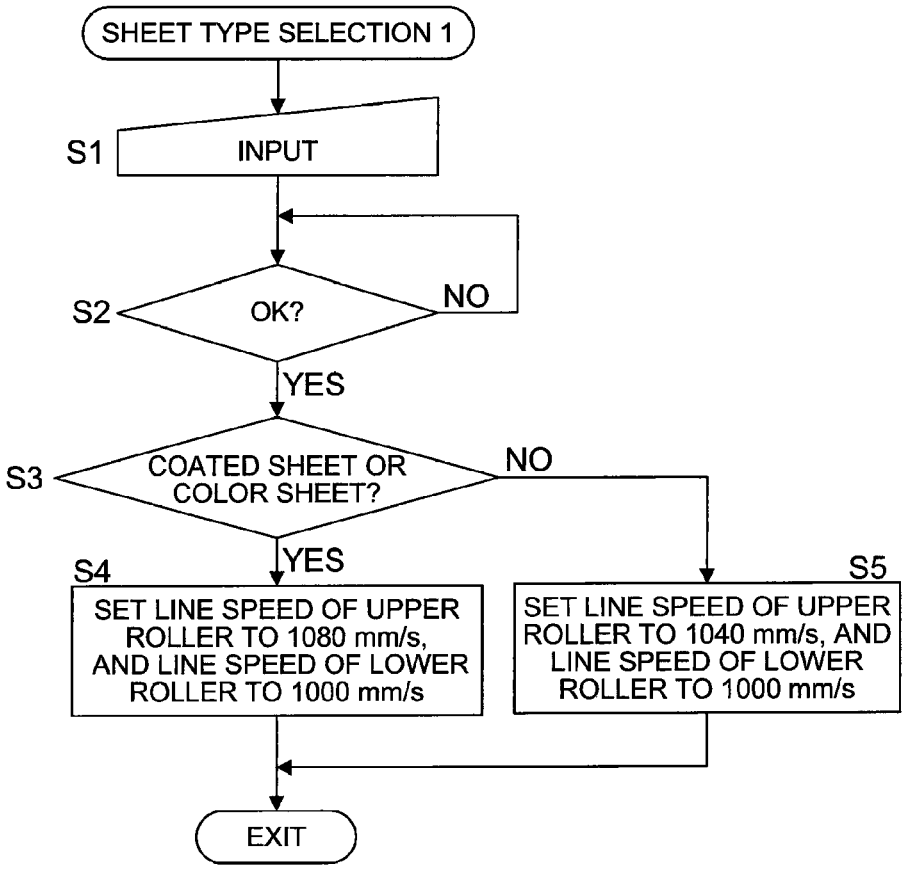

FIGS. 5A-5B are diagrams showing control for changeable line speed of conveyance roller R3, and FIG. 5A shows an input screen for a user, and FIG. 5B shows a control flow chart for controller CC.

In Example 1-1, a line speed of the upper roller 101 is changed depending on a sheet type inputted by a user, for controlling a shift amount depending on sheet types. On the other hand, the lower roller 102 is controlled to be at the fixed speed. Since there is a difference of line speed between the upper roller and the lower roller, sheets are conveyed so that the sheet on the upper roller side may precede.

FIG. 5A shows a screen for selecting a sheet type of operation display section tp, and a type of a sheet used by a user is selected with a touch panel. The screen of selecting sheet type in FIGS. 5A-5B is selected with the operation display section tp by switching the screen in the way of passing through applied setting, sheet finishing, setting of shift amount and sheet type selection, on operation display section tp. On the screen of selecting sheet type, a user selects any one of a coated sheet, a color sheet, normal sheet and a quality sheet for the sheet to be used, and presses OK button for settlement.

A flow chart of control in FIG. 5B shows a flow of control that is performed by controller CC in accordance with types of the sheet selected, in which, manual inputting (sheet selection) by a user is performed in step S1, and when an OK button is pressed in step S2 (actually, input information is transmitted to controller CC from controller CA), a flow is branched to step S4 or step S5 depending on the sheet type selected in step S3.

When the sheet type is a coated sheet or a color sheet, a flow advances to step S4, and a line speed of the upper roller is set to 1080 mm/s and a line speed of the lower roller is set to 1000 mm/s. On the other hand, when the sheet type is that of a normal sheet or a quality sheet, a line speed of the upper roller is set to 1040 mm/s and a line speed of the lower roller is set to 1000 mm/s in step S5.

Since the coated sheet and the color sheet have undergone surface treatment, their air permeability is low and smoothness is high, compared with normal sheet or the like. Therefore, the sheet hardly slips, and a line speed of the upper roller is set to be higher than that for a normal sheet. The air permeability is a rate of escaping of air from a sheet surface, and the air-releasing rate of a coated sheet is low because the coated sheet has undergone surface treatment, while, when superimposed two sheets are interposed by the conveyance rollers and air between them leaves, the sheets become to be in the state of the so-called adsorption, and they hardly slip. Further, since the smoothness is high, sheet adhesion is excellent, and air does not enter the space between sheets interposed by the conveyance rollers.

EXAMPLE 1-2

Example 1-2 is one wherein inputting of a sheet thickness is added to Example 1-1, and pressing force of the upper roller and that of the lower roller are changed based on the information of this sheet thickness. In the reason for the above, since the sheets are shifted by a difference of line speeds of conveyance roller R3, if a pressing force is large for a thick sheet, the sheet is damaged, while, for a thin sheet, if a pressing force is small for a thin sheet, a slip is caused between sheets, and a shift amount is reduced, therefore, the pressing force is changed depending on a thickness of the sheet.

A change of the pressing force is made by the mechanism shown in FIG. 4. Namely; bearing 201A and bearing 201B are provided between roller bodies on the upper roller, and eccentric cam 202A is caused to be in contact with the bearing 201A and eccentric cam 202B is caused to be in contact with the bearing 201B. The eccentric cam 202A and the eccentric cam 202B are supported on shaft 203, and when the shaft 203 is rotated by motor 204, axial loads of the upper roller 101 against the lower roller 102 are changed.

Figure 6A:
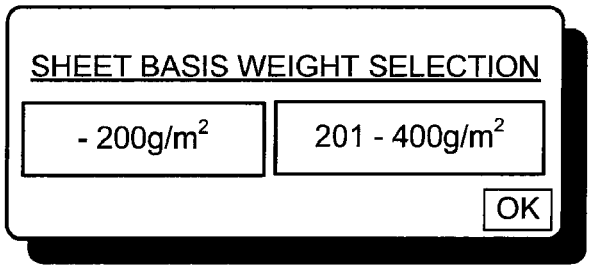
FIG. 6A and FIG. 6B show respectively a sheet selecting screen and a control flow chart in Example 1-2 of the invention.

FIG. 6A is a screen on which a thickness of a sheet is inputted, and it is selected by switching screens in the order of applied setting, sheet finishing, setting of shift amount and sheet basis weight selection, on operation display section tp, in the same way as in the sheet type selection screen. A thickness of the sheet is displayed in a unit of a basis weight, and it is established in two steps including a step that is 200 g/m$^2$ or less and a step ranging from 201 g/m$^2$ to 400 g/m$^2$. A user selects a button corresponding to a thickness of the sheet to be used, and presses an OK button to confirm the input.

Figure 6B:
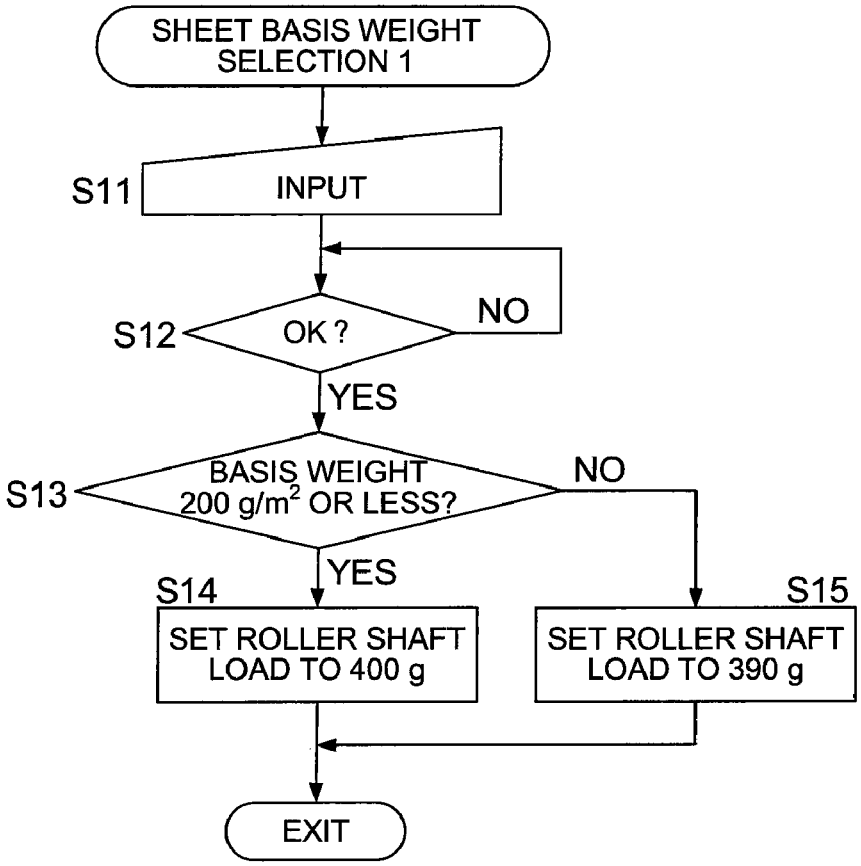

A flow chart of the control shown in FIG. 6B shows a flow of the control conducted by controller CC, then, manual inputting (selection of a basis weight) by a user is performed in step S11, and when an OK button is depressed in step 12, branching is carried out to step S14 or step S15 depending on the basis weight of the sheet selected in step S13. When a basis weight of the sheet is 200 g/m$^2$ or less, a flow advances to step S14 and an axial load for the roller is set to 400 g, and when a basis weight of the sheet is in the range of 201-400 g/m$^2$, an axial load for the axis is set to 390 g.

The controller CC conducts controls shown in flow charts for both regulations in FIG. 5B and FIG. 6B.

Figure 7A:
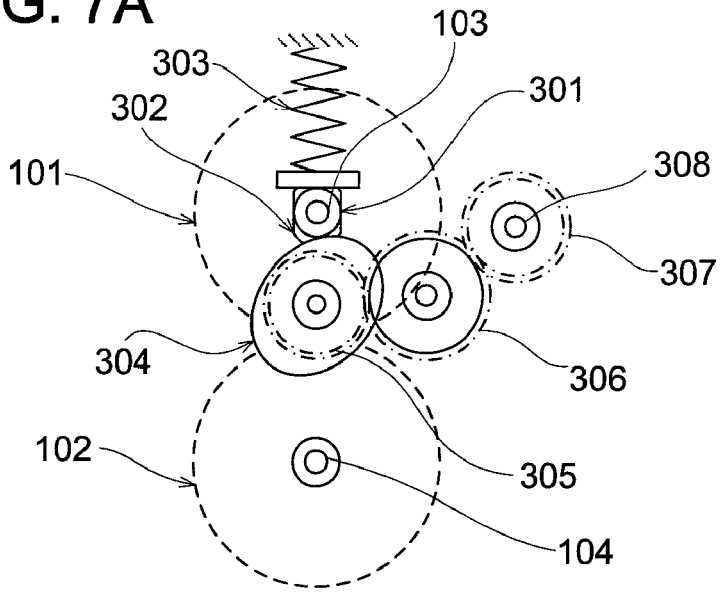
FIG. 7A and FIG. 7B show respectively a side view of conveyance roller R3 and a control flow chart in a variation of Example 1-2 of the invention.
Figure 7B:
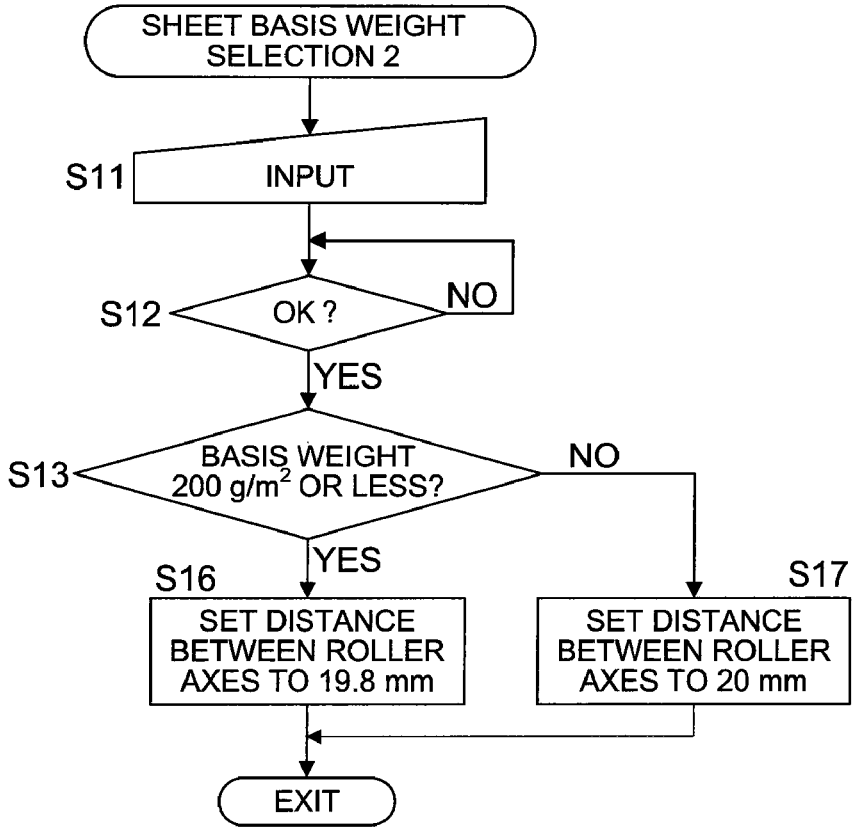

FIG. 7A and FIG. 7B show an example of variation for a change of pressing force of conveyance roller R3. FIG. 7A is a side view of supporting plate 60 for holding conveyance roller R3 that is viewed from the outside, and it holds, on a movable manner, bearing 301 supporting the shaft 103 of the upper roller 101 through elongated hole 302 that is provided on the supporting plate 60. The bearing 301 is urged by spring 303 toward the lower roller 102 side, and eccentric cam 304 is in contact with its opposite side.

Gear 305 provided on the shaft on which the eccentric cam 304 is provided is engaged with gear 307 through gear 306, and an unillustrated motor is connected to shaft 308 of gear 307. The same mechanism is provided also on supporting plate 60 on the back side, and it is caused to interlock through shaft 37. In this construction, when the motor is rotated by an amount of a prescribed angle, the eccentric cam 304 is rotated to cause shaft 103 of the upper roller 101 to rise and fall, thereby, a distance between shafts is changed.

FIG. 7B is a flow chart showing a flow of control of controller CC that changes the distance between shafts and portions from step S11 to step S13 of the flow chart are the same as those in FIG. 6B. In the case of YES in step S13 (basis weight 200 g/m$^2$ or less), a distance between shafts for rollers is set to 19.8 mm in step S16, while, in the case of NO (basis weight 201-400 g/m$^2$) in step S13, a distance between shafts for rollers is set to 20 mm in step S17. Examples of variation shown in the FIGS. 7A-7B also exhibit actions which are the same as those in the examples in FIG. 6A-6B.

In the examples of variation, controller CC conducts for both shown in FIG. 5B and FIG. 7B.

As stated above, in Example 1-2, a difference of line speed of conveyance roller R3 is established based on the sheet type, and further, pressing force (axial load, or distance between shafts) for rollers is changed depending on a thickness of a sheet, which makes a shift amount for a sheet to be appropriate, and makes a damage on a sheet to be lightened.

Although a difference of line speeds was established based on a sheet type and pressing force of the roller was changed depending on a sheet thickness in Example 1-2, it is also possible to fix the difference of line speeds and to adjust only pressing force depending on a sheet thickness, as a special occasion. This occasion, for example, is a moment wherein sheets to be used by a user are limited, and a thickness of the sheet only is changed. In the occasion of this kind, it is possible to fix the setting of line speed difference based on the sheet type in Example 1-2 and to make a screen to be established by a user to be only a screen to establish pressing force based on a thickness of a sheet. Owing to this, an inputting job of a user is simplified.

EXAMPLE 1-3

Example 1-3 is an example in a form to input a shift amount directly (also referred to as an adjustment amount inputting section). In this example, test printing is carried out first, and a shift amount is established based on the amount of actual shifting by observing the sheet bundle which has undergone actual stapling in the test printing. With respect to a line speed of conveyance roller R3 of the second sheet finisher C, the line speed of 1060 mm/s is set for the upper roller and the line speed of 1000 mm/s is set for the lower roller, both as an initial value, for example, and for the line speed of the upper roller, this initial value is increased or decreased.

Figure 8A:
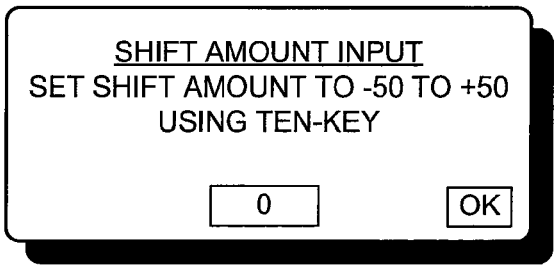
FIG. 8A-FIG. 8C show respectively a sheet selecting screen and a control flow chart in Example 1-3 of the invention.

FIG. 8A shows a screen on which a shift amount is inputted, and in the same way as in the sheet type selection screen, a selection of the screen is made by operation display section tp by switching the screen in the way of passing through applied setting, sheet finishing, setting of shift amount and inputting of shift amount, thus, numerical inputting for an amount of correction is carried out by the operation display section tp, and it is defined by an OK button. On the lower part of this screen for inputting, there is a numerical display section that displays numerical values which are inputted by a ten-key. An initial value for the display is "0".

Figure 8B:
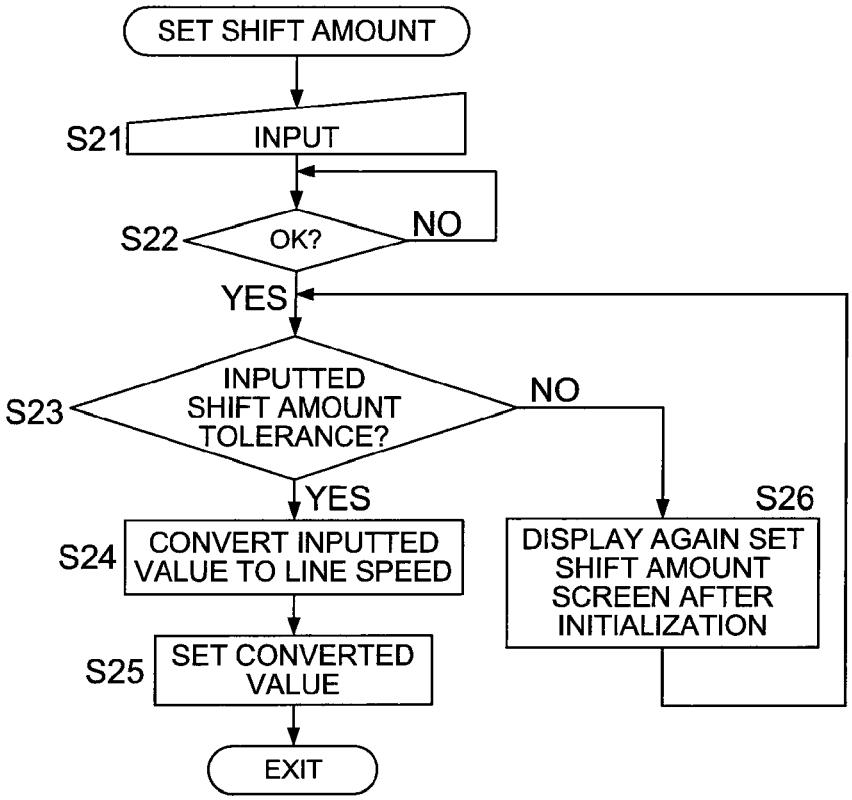

FIG. 8B shows a flow chart of the aforesaid control conducted by controller CC, and in the flow chart, when an inputted value is defined in steps S21 and S22, a judgment is made in step S23 whether a shift amount is within a tolerance or not, first. When the shift amount is within a tolerance, an amount of correction inputted is converted into a line speed of the upper roller, and a converted value is set up in step S25.

When the shift amount exceeds a tolerance, in the judgment in step S23, the shift amount input screen is initialized in step S26 to be displayed again.

In Example 1-3, it is possible to align sheets accurately because a value for correction is inputted after the shifting of the stapled sheet bundles is observed actually, and Example 1-3 is especially effective when the shifting cannot be dissolved perfectly with a type and a thickness of the sheet, in the case of using under the conditions of specific sheet and specific environment.

Further, though an example to make fine adjustments for a difference of line speeds of conveyance rollers is shown in Example 1-3, the invention can also be applied to fine adjustments for pressing force between upper and lower rollers in place of a difference of line speeds. In this case, values to be converted and established in steps S24 and S25 can be made to be pressing forces.

Further, though an initial value of a line speed of the upper roller is made to be 1060 mm/s in the aforesaid explanation, it is also possible to establish a line speed of a roller under the sheet selection in Example 1-1, and then, to make fine adjustments in a pattern in Example 1-3. In addition, it is also possible to change a line speed of the upper roller under the assumption that the inputted numerical value shows a difference of line speeds for the lower roller line speed (fixed).

Further, it is also possible to make fine adjustments for a difference of line speeds of conveyance rollers established by sheet selection in Example 1-1, and to make fine adjustments for pressing forces of upper and lower rollers established by a thickness and input of the sheet in Example 1-2.

Figure 8C:
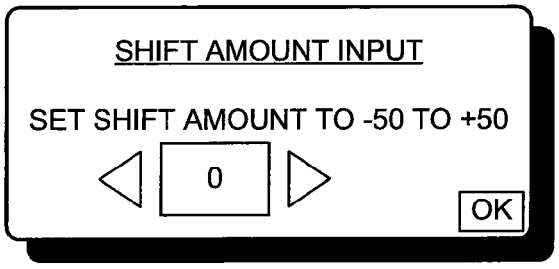

FIG. 8C is an example of a variation of a shift amount input screen wherein numerical values are inputted by keys for ups and downs (triangle buttons) in place of a ten-key. When a line speed of a roller is established through sheet selection and a value for fine adjustments is inputted, the establishment can be made sufficiently even by the keys for ups and downs because a value for inputting is small.

EXAMPLE 2

Figure 9:
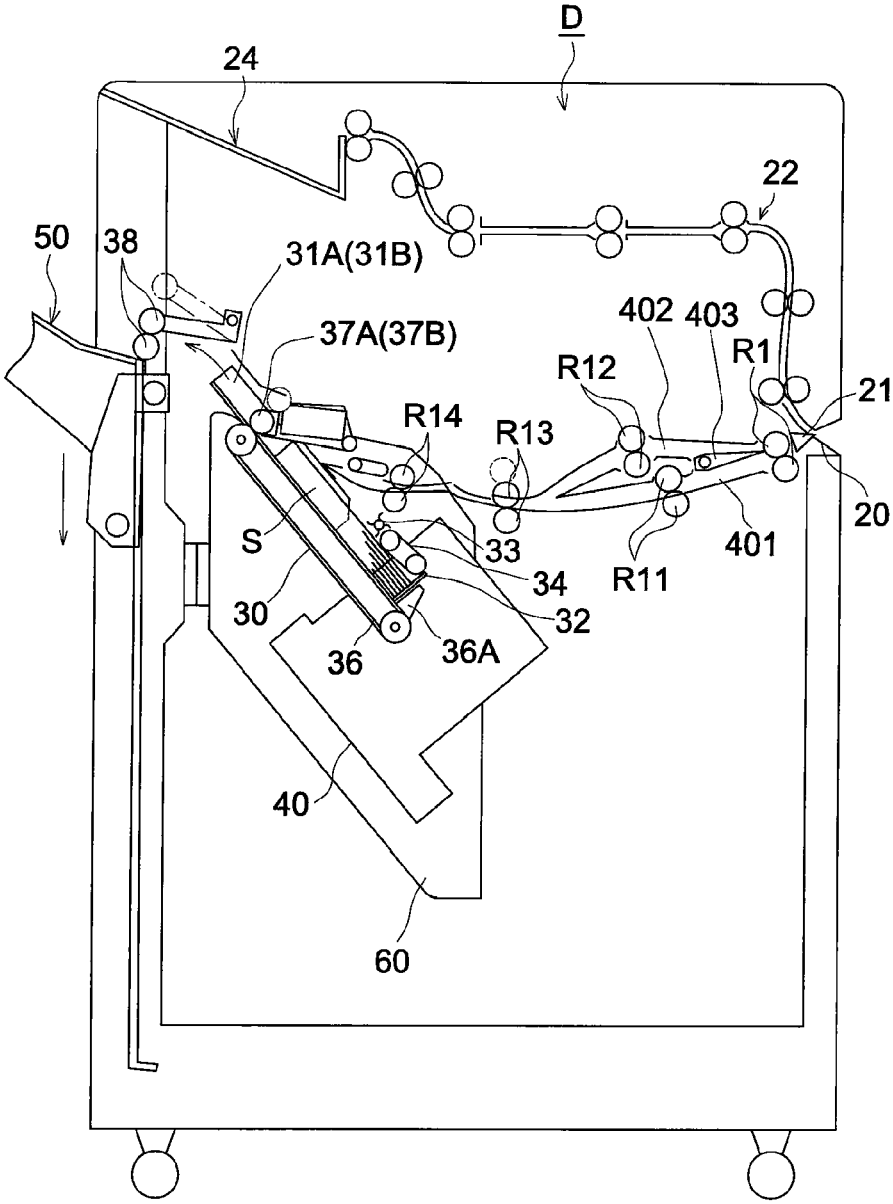
FIG. 9 is a sectional view of a sheet finisher that explains Example 2 of the invention.

FIG. 9 is a sectional view showing the structure of the third sheet finisher D in Example 2. Though the aforesaid each example has the structure wherein two sheets are superimposed by the first sheet finisher B to be two-ply sheets, and these sheets are shifted forcibly by the second sheet finisher C, a two-ply superimposing mechanism for sheets is provided in the third sheet finisher D in Example 2. In this case, the first sheet finisher B is not needed, and image forming apparatus A and the third sheet finisher D can be connected directly with each other.

In FIG. 9, constitution to eject a sheet to fixed sheet-ejection section 24 through conveyance path 22 and constitutions including stacking section 30 and thereafter are the same as those in Example 1-1. Therefore, explanations for them are omitted here and changed portions only will be explained below.

A conveyance path provided on the left side of conveyance path switching member 21 on the side of introduction port 20 in the drawing is branched into two paths including conveyance path 401 and conveyance path 402 at the downstream side of conveyance roller R1, and conveyance path switching claw 403 is arranged for switching between respective conveyance paths.

Conveyance rollers R11 are arranged on the half way of conveyance path 401 and conveyance rollers R12 are arranged on the half way of conveyance path 402, and at their downstream side, the two conveyance paths join each other, to be connected to conveyance rollers 13 and to conveyance rollers 14. In this case, each of conveyance rollers R11 and R12 is driven independently, and the conveyance rollers R12 is structured to be of variable speed. Further, the conveyance rollers R13 are structured so that the upper roller may be separated as shown with dotted lines. The conveyance rollers 14 are those whose speed is constant, which is different from Example 1-1.

When the first sheet is introduced through the introduction port 20, conveyance path switching claw 403 introduces the sheet to conveyance path 401 under the illustrated condition. In this case, conveyance rollers R13 are stopped running at the position shown with solid lines. Therefore, a leading edge of the sheet is stopped by the conveyance rollers R13. At the timing when a leading edge of the sheet arrives at the conveyance roller R13, driving of conveyance roller R11 is stopped.

After that, when the second sheet comes in, the conveyance path switching claw 403 is tilted downward to introduce the sheet to conveyance path 402. When a leading edge of the second sheet arrives at conveyance rollers 13, the second sheet is superimposed on the first sheet to be aligned in terms the leading edge. Under this condition, the conveyance rollers 13 are separated to be in the state shown with dotted lines, and conveyance rollers R11 and conveyance rollers R12 start rotating at a prescribed speed. A line speed of the conveyance rollers is 1000 mm/s, and a line speed of the conveyance rollers R12 is set to 1080 mm/s depending on a coated sheet or a color sheet in accordance with selection of sheet type shown in FIGS. 5A-5B, and it is set to 1040 mm/s in the case of a normal sheet or a quality sheet.

When two sheets are at the position of conveyance rollers R13, leading edges of two sheets are aligned. However, during the period for the two sheets to move from the conveyance rollers R13 to conveyance rollers R14, the sheet on the upper side (second sheet passing through conveyance path 402) is caused by a difference of line speeds between conveyance rollers R11 and conveyance rollers R12 to precede to be in the state where the sheet on the upper side is preceded by a prescribed shift amount. Under this state of shifting, two sheets are fed in stacking section 30 from the conveyance rollers R14.

In Example 2 mentioned above, the first sheet and the second sheet pass through the branched conveyance paths respectively, and conveyance speeds for the first sheet and the second sheet are made to be different from each other to shift the two sheets. In this way, a conveyance speed is changed in accordance with a type of the sheet to stabilize a shift amount.

Further, it is possible to make a shift amount to be more stable by changing pressing force of a conveyance roller in accordance with a thickness of the sheet, in the same way as in Example 1-2. In this case, with respect to changing of pressing force of conveyance rollers, the change of the pressing force of the conveyance rollers R12 alone is somehow enough, but the change of the pressing force of the additional conveyance rollers R11 results in more stability of a shift amount. For selections of the aforesaid sheet types and pressing force, FIGS. 5A-8C can be applied.

[Other Variations]

Though there have been explained the examples each being different from others greatly, in the aforesaid explanation of the examples, it is further possible for the invention to have various variations, and the various variations will be explained as follows.

In the aforesaid examples, an explanation has been given in the example wherein a sheet type and a sheet thickness for changing shifting conditions are inputted. However, it is also possible to change the shifting conditions based on information established in each sheet storage section in advance. For example, pieces of information such as a normal sheet with basis weight of 100 g/m$^2$ for the first sheet storage section and a color sheet with basis weight of 150 g/m$^2$ are established in advance in image forming apparatus A, and shifting conditions are changed by transmitting the sheet information to the sheet finisher based on selection of a sheet to be used or of a sheet storage section for storing the sheet. Using the sheet information of the sheet set in advance also constitutes an input section of the invention.

Further, there has been given the explanation of the construction wherein an outlet is located at the upper part obliquely in stacking section 30, and a sheet is carried in toward the outlet, then, the sheet is moved in the direction opposite to the aforesaid carrying in direction toward a stopper that is provided in the direction opposite to the sheet carrying in direction. However, it is also possible to prove a stopper at the lower part obliquely of the stacking section that is arranged to be tilted, and to carry in a sheet toward the aforesaid stopper. In this case again, the sheet located at the lower side on the stacking section is shifted and controlled so that the sheet may precede toward the stopper.

Further, with respect to a sheet finishing section, it has been explained, referring to the stapler section that conducts edge stapling. However, it may also be other sheet finishing sections such as, for example, punching processing, center stapling processing, shift processing and bookbinding processing.

Incidentally, a sheet is not limited to those on which images have been formed by an image forming apparatus, and it may also be a sheet that is inserted as a cover or a dividing sheet, or a sheet that undergoes image forming conducted by another image forming apparatus and is stored in a sheet storage section. In the case of the latter, the inside of the image forming apparatus is used for the sheet to pass through only, and it is not used for forming images.

What is claimed is:

1. A sheet finisher comprising:

(a) a stacking section having a stacking surface arranged to be tilted, and a stopper located below the stacking surface;

(b) a sheet finishing section which post-processes for a sheet bundle that hits the stopper and is stacked on the stacking section;

(c) a conveying section which sends two sheets to the stacking section under the condition that the two sheets are shifted each other in a conveyance direction thereof and are superimposed;

(d) an input section in which sheet type information for a sheet is inputted; and (e) a controller which adjusts a shift amount between the two sheets so that the sheet on a lower side precedes toward the stopper by a prescribed amount, when a conveyance condition of the conveyance section is changed based on the sheet type information inputted by the input section, and the two sheets are conveyed to the stacking section with the two sheets superimposed.

2. The sheet finisher of claim 1, wherein the sheet type information is a sheet kind, the conveyance condition to be changed is a difference between line speeds with respect to the two sheets, and the controller adjusts the difference between the line speeds of the conveying section with respect to the two sheets in accordance with the inputted sheet kind.

3. The sheet finisher of claim 1, wherein the sheet type information is a sheet kind and a sheet thickness, the conveyance condition to be changed is a difference between line speeds with respect to the two sheets and pressing force, and the controller changes the difference between line speeds of the conveying section with respect to the two sheets according to the inputted sheet kind, and changes the pressing force of the conveying section according to the inputted sheet thickness.

4. The sheet finisher of claim 1, wherein the conveying section comprises a pair of conveyance rollers, which supplies two superimposed sheets to the pair of conveyance rollers, and shifts the sheets according to a difference between line speeds of respective rollers of the pair of conveyance rollers.

5. The sheet finisher of claim 1, wherein the conveying section comprises two sets of conveyance paths which join after being branched, which supplies a single sheet into each of the conveyance paths, superimposes the two sheets, and shifts the two sheets according to a difference between line speeds of respective conveyance rollers arranged respectively in the conveyance paths.

6. The sheet finisher of claim 1, further comprising an adjustment amount inputting section which further adjusts the changed conveyance condition of the conveying section.

7. The sheet finisher of claim 1, wherein the stacking section comprises an urging member which urges the sent sheet from an upper side thereof to the stacking surface toward the stopper.

8. An image forming system comprising:

the sheet finisher of claim 1; and an image forming apparatus.

9. A sheet finisher comprising:

(a) a stacking section having a stacking surface arranged to be tilted, and a stopper located below the stacking surface;

(b) a sheet finishing section which post-processes on a sheet stacked on the stacking section;

(c) a conveying section having a pair of conveyance rollers, which supplies two superimposed sheets to the pair of conveyance rollers, and supplies the sheets to the stacking section by shifting the sheets according to a difference between line speeds of respective rollers of the pair of conveyance rollers, and delivers the sheets by shifting the sheets so that the sheet on a lower side precedes toward the stopper, when the two sheets are delivered to the stacking section with the two sheets superimposed, and aligns the sheets by causing end portions of the sheets to hit the stopper;

(d) an input section into which sheet type information for a sheet is inputted; and (e) a controller which changes a conveyance condition of the pair of conveyance rollers in accordance with the sheet type information inputted by the input section, and adjusts the shift amount between the sheets so that the sheet on the lower side precedes toward the stopper by a prescribed amount.

10. The sheet finisher of claim 9, wherein the sheet type information is a sheet kind, the conveyance condition to be changed is a difference between line speeds with respect to the two sheets, and the controller adjusts the difference between the line speeds of the conveying section with respect to the two sheets in accordance with the inputted sheet kind.

11. The sheet finisher of claim 9, wherein the sheet type information is a sheet kind and a sheet thickness, the conveyance condition to be changed is a difference between line speeds with respect to the two sheets and pressing force, and the controller changes the difference between line speeds of the pair of conveyance rollers with respect to the two sheets according to the inputted sheet kind, and changes the pressing force of the pair of conveyance rollers to the sheets according to the inputted sheet thickness.

12. The sheet finisher of claim 9, wherein the conveying section comprises a sheet superimposing section in which a preceding sheet of successively conveyed sheets is stopped temporarily, then is superimposed with a succeeding sheet, and then is conveyed to the pair of conveyance rollers.

13. The sheet finisher of claim 9, further comprising an adjustment amount inputting section which further adjusts the changed conveyance condition of the pair of conveying rollers.

14. The sheet finisher of claim 9, wherein the stacking section comprises an urging member which urges the sent sheet from an upper side thereof to the stacking surface toward the stopper.

15. An image forming system comprising:
the sheet finisher of claim 9; and
an image forming apparatus.

16. A sheet finisher comprising:
(a) a stacking section having a stacking surface arranged to be tilted and a stopper located below the stacking surface;
(b) a sheet finishing section which post-processes on a sheet stacked on the stacking section;
(c) a conveying section having two sets of conveyance paths which join after being branched, which supplies sheets to the stacking section by superimposing two sheets by delivering a single sheet into each of the conveyance paths, and by shifting the two sheets according to a difference between line speeds of respective conveyance rollers arranged respectively in the conveyance paths, and delivers the sheet on a lower side by shifting so that the sheet on the lower side precedes toward the stopper and aligns the sheet on the lower side by causing an end portion of the sheet to hit the stopper, when the sheet is delivered under the condition that the two sheets are superimposed on the stacking section;
(d) an input section into which sheet type information for a sheet is inputted; and
(e) a controller which changes a conveyance condition of the conveyance rollers in accordance with the sheet type information inputted by the input section, and regulates a shift amount between the two sheets so that the sheet on the lower side precedes toward the stopper by a prescribed amount.

17. The sheet finisher of claim 16, wherein the sheet type information is a sheet kind, the conveyance condition to be changed is a difference between line speeds of each of the conveyance rollers with respect to the two sheets, and the controller adjusts the difference between the line speeds of each of the conveyance rollers with respect to the two sheets in accordance with the inputted sheet kind.

18. The sheet finisher of claim 16, wherein the sheet type information is a sheet kind and a sheet thickness, the conveyance condition to be changed is a difference between line speeds with respect to the two sheets and pressing force, and the controller changes the difference between line speeds of each of the conveyance rollers with respect to the two sheets according to the inputted sheet kind, and changes the pressing force of each of the conveyance rollers to the sheets according to the inputted sheet thickness.

19. The sheet finisher of claim 16, further comprising an adjustment amount inputting section which further adjusts the changed conveyance condition of the pair of conveying rollers.

20. The sheet finisher of claim 16, wherein the stacking section comprises an urging member which urges the sent sheet from an upper side thereof to the stacking surface toward the stopper.

21. An image forming system comprising:
the sheet finisher of claim 16; and
an image forming apparatus.

22. A sheet finisher comprising:
(a) a stacking section having a stacking surface arranged to be tilted and a stopper located below the stacking surface;
(b) a sheet finishing section which post-processes on a sheet stacked on the stacking section;
(c) and a conveying section which delivers two sheets to the stacking section under the condition that the two sheets are shifted each other in a conveyance direction, and delivers the sheet on the lower side by shifting so that the sheet on the lower side precedes toward the stopper and aligns the sheet on the lower side by causing an end portion of the sheet to hit the stopper, when the sheet is delivered to the stacking section with the two sheets superimposed;
(d) an input section into which a shift amount between the two sheets is inputted; and
(e) a controller which changes a conveyance condition of the conveying section in accordance with the shift amount inputted into the input section, and regulates the shift amount for the two sheets so that the sheet on the lower side on the stacking side precedes toward the stopper by a prescribed amount.

23. The sheet finisher of claim 22, wherein the controller changes a difference between line speeds of the conveying section with respect to the two sheets in accordance with the inputted shift amount.

24. The sheet finisher of claim 22, wherein the conveying section comprises a pair of conveyance rollers, which supplies two superimposed sheets to the pair of conveyance rollers, and shifts the sheets according to a difference between line speeds of respective rollers of the pair of conveyance rollers.

25. The sheet finisher of claim 22, wherein the conveying section comprises two sets of conveyance paths which join after being branched, which supplies a single sheet into each of the conveyance paths, superimposes the two sheets, and shifts the two sheets according to a difference between line speeds of respective conveyance rollers arranged respectively in the conveyance paths.

26. The sheet finisher of claim 22, further comprising an input section in which sheet type information for a sheet is inputted, wherein the controller changes pressing force of the conveying section to the sheet according to the inputted sheet type information of the sheet.

27. The sheet finisher of claim 22, wherein the stacking section comprises an urging member which urges the sent sheet from an upper side thereof to the stacking surface toward the stopper.

28. An image forming system comprising:
the sheet finisher of claim 22; and
an image forming apparatus.

* * * * *